US011002017B2

(12) United States Patent
Han

(10) Patent No.: US 11,002,017 B2
(45) Date of Patent: May 11, 2021

(54) VARIABLE-OPERATED TIMBER SCREENS FOR THREE-DIMENSIONAL DECORATION AND LIGHTING CONTROL OF BUILDINGS FACADES

(71) Applicant: Eunju Han, Seoul (KR)

(72) Inventor: Eunju Han, Seoul (KR)

( * ) Notice: Subject to any disclaimer, the term of this patent is extended or adjusted under 35 U.S.C. 154(b) by 348 days.

(21) Appl. No.: 16/093,169

(22) PCT Filed: Mar. 17, 2017

(86) PCT No.: PCT/KR2017/002906
§ 371 (c)(1),
(2) Date: Oct. 12, 2018

(87) PCT Pub. No.: WO2017/188599
PCT Pub. Date: Nov. 2, 2017

(65) Prior Publication Data

US 2019/0119921 A1 Apr. 25, 2019

(30) Foreign Application Priority Data

Apr. 27, 2016 (KR) ..... 10-2016-0051295

(51) Int. Cl.
*E04F 10/10* (2006.01)
*E04F 13/10* (2006.01)
(Continued)

(52) U.S. Cl.
CPC ..... *E04F 10/10* (2013.01); *E04F 13/0862* (2013.01); *E04F 13/10* (2013.01);
(Continued)

(58) Field of Classification Search
CPC ..... E04F 10/08; E04F 10/10; E04F 13/0862; E04F 13/10; G09F 11/00; G09F 11/025;
(Continued)

(56) References Cited

U.S. PATENT DOCUMENTS 1,721,998 A * 7/1929 Jackson, Jr. ..... E06B 9/0653 160/137
2,455,112 A * 11/1948 Christison ..... E06B 9/0653 160/32
(Continued)

FOREIGN PATENT DOCUMENTS

KR 20-1999-0011744 U 3/1999
KR 20-0212002 Y1 2/2001
(Continued)

*Primary Examiner* — Johnnie A. Shablack
(74) *Attorney, Agent, or Firm* — Rabin & Berdo, P.C.

(57) ABSTRACT

The present invention relates to a variably operable timber screen for three-dimensional decoration of a building exterior wall and shading control of a building, the screen comprising: a pair of rails (10*a* and 10*b*); a motor (20); a timing belt (30); several pairs of rollers (40); a plurality of columns (50); a plurality of bearings (60); a rotational force transmitter bar (70); a plurality of decorative timber blade units (80); an manipulation unit (90); and a control unit (100). Therefore, the present invention can not only make the exterior of a building itself more attractive, but can also control the amount of incident sunlight through windows and doors.

6 Claims, 8 Drawing Sheets

(51) Int. Cl.

| | |
|---|---|
| ***G09F 9/37*** | (2006.01) |
| ***G09F 11/02*** | (2006.01) |
| ***E04F 13/08*** | (2006.01) |
| ***G09F 11/00*** | (2006.01) |
| ***G09F 23/02*** | (2006.01) |

(52) U.S. Cl.
CPC ..... *G09F 9/372* (2013.01); *G09F 11/00* (2013.01); *G09F 11/025* (2013.01); *G09F 23/02* (2013.01)

(58) Field of Classification Search
CPC ..... G09F 11/12; G09F 11/14; G09F 23/02; E06B 9/06; E06B 9/063; E06B 9/0638; E06B 9/0661; E06B 9/0653; E06B 9/0646; E06B 9/02; E06B 7/08; E06B 7/084; E06B 7/092
See application file for complete search history.

(56) References Cited

U.S. PATENT DOCUMENTS

| | | | | | |
|---|---|---|---|---|---|
| 2,493,815 | A * | 1/1950 | Guilbert, Jr. | E06B 9/063 | 160/206 |
| 3,419,063 | A * | 12/1968 | Mock | E06B 9/262 | 160/199 |
| 4,006,768 | A * | 2/1977 | Horgan, Jr. | E06B 9/063 | 160/136 |
| 4,128,307 | A * | 12/1978 | Badertscher | E04F 10/10 | 359/596 |
| 4,243,090 | A * | 1/1981 | Kemp | E06B 9/063 | 160/145 |
| 4,799,528 | A * | 1/1989 | Benitez | E06B 3/481 | 160/199 |
| 5,255,465 | A * | 10/1993 | Perez | G09F 11/025 | 40/504 |
| 5,373,887 | A * | 12/1994 | Glover | E05D 15/26 | 160/206 |
| 7,921,586 | B2 * | 4/2011 | Reynolds, IV | G09F 11/025 | 40/505 |
| 8,250,793 | B1 * | 8/2012 | Halula | G09F 11/025 | 40/503 |
| 8,534,343 | B2 * | 9/2013 | Yi | E06B 9/0661 | 160/102 |
| 9,145,732 | B2 * | 9/2015 | Frigerio | E04B 7/163 | |
| 2006/0144528 | A1 * | 7/2006 | Lee | E06B 9/0669 | 160/183 |
| 2007/0245631 | A1 * | 10/2007 | Yi | E06B 9/0661 | 49/55 |
| 2018/0080433 | A1 * | 3/2018 | Te | F03D 5/02 | |
| 2019/0119921 | A1 * | 4/2019 | Han | E04F 10/10 | |

FOREIGN PATENT DOCUMENTS

| | | | |
|---|---|---|---|
| KR | 20-0277947 | Y1 | 6/2002 |
| KR | 20-0310927 | Y1 | 4/2003 |
| KR | 10-2005-0020118 | A | 3/2005 |
| KR | 10-2009-0047414 | A | 5/2009 |
| KR | 10-1189735 | B1 | 10/2012 |

* cited by examiner

VARIABLE-OPERATED TIMBER SCREENS FOR THREE-DIMENSIONAL DECORATION AND LIGHTING CONTROL OF BUILDINGS FACADES

TECHNICAL FIELD

The present invention relates to a variably operable timber screen for three-dimensional decoration of a building exterior wall and shading control of a building. More particularly, the present invention relates to a variably operable timber screen that is provided with a decorative timber blade unit, etc., and is installed in variable operating type at a building exterior wall and has a simple structure and an attractive appearance, and can adjust the amount of incident sunlight as needed. Also, specific pictures or letters are provided at an outer surface of the decorative timber blade unit of the screen, so that the variably operable timber screen can make a more attractive appearance of the building and further can have a function as a banner and a signboard capable of performing card section.

BACKGROUND ART

In Korea, that is located in northern hemisphere, seasonal winds blow from the same direction every year.

In summer, the Asian continent warms up and a low pressure center is created on land, and wind from southeast and southwest blows to the low pressure center from the ocean. In other words, a sweltering high temperature and humidity wind blows in Korea from June until September. On the contrary, in winter, the Asian continent gets colder and temperature drops, a large high pressure, such as Siberian anticyclone, is created and wind blows therefrom to the ocean, so that very cold and dry wind blows from northwest through Korea.

In buildings or houses, a window system having two different functions such as blocking outside noise and blocking inside noise, controlling the ventilation and shading, and blocking the inside of a building from and the outside is provided. The window system is configured such that an opening is provided in a predetermined part of an exterior wall and a window frame is fixed to the opening, and then a window that slides in left and right sides is installed inside the window frame to enable shading and ventilation through the window.

However, in Korea, since it is preferred for houses to face south in consideration of a sunlight condition, even though a part or whole of windows thereof installed to the south is opened, it is difficult for natural seasonal wind flowing from east and west to flow easily into a room through the windows in summer.

The natural wind flowing through the windows is very useful for ventilating indoor air and reducing indoor temperature in summer, but when indoor ventilation is inadequate, the indoor air becomes stuffy and the indoor temperature rises.

Moreover, in houses or stores, an awning apparatus is installed over an upper part of a door or a window for blocking excessive direct sunlight.

Such an awning apparatus is usually installed over the window, a show window, a door, or a building exterior wall, and used to provide a pleasant environment and protect goods in the stores by blocking the sunlight or rainwater.

Recently, the awning apparatus has used not only as protective use but also as decorative use by having a visual effect using various shapes or colors, and as various purposes such as obtaining a business synergy effect by attracting public attention.

In the traditional awning apparatus, a manual operated style for manually opening and closing an awning, a motor operated style for opening and closing an awning by electric power, or a fixed style is used.

Hereinabove, an awning apparatus of the fixed style is inexpensive but has use restrictions because it may not be opened or closed as needed (it is difficult to adjust the amount of incident sunlight according to needs of an user), and an awning apparatus of the motor operated style is expensive to manufacture.

Meanwhile, it is a recent trend to design the building exterior wall to be attractive using the various shapes through a curtain wall method, for this purpose, there are various demands for three-dimensional decoration of the building exterior wall and shading of the building (for example, blocking and allowing direct sunlight through the window, preventing easy breakage of the window and intrusion of outsiders through the window, ensuring privacy protection through the window, and ensuring a view from the window etc.), and in existing buildings, there are also demands for three-dimensional decoration of the existing buildings and shading control of the buildings by building owners.

DOCUMENTS OF RELATED ART (Patent Document 1) Korean Patent Application Publication No. 10-2009-0047414 (May 12, 2009)

(Patent Document 2) Korean Patent No. 10-1189735 (Oct. 4, 2012)

DISCLOSURE

Technical Problem

Accordingly, the present invention has been made keeping in mind the above problems occurring in the prior art, and an object of the present invention is to provide a variably operable timber screen for three-dimensional decoration of a building exterior wall and shading control of a building, in which the timber screen can create a more attractive appearance of the building exterior wall by installing a screen made of a plurality of decorative timber blade units with a simple structure in variable operating type at the building exterior wall, and can adjust the amount of sunlight incident through a window.

Another object of the present invention is to provide a variably operable timber screen for three-dimensional decoration of a building exterior wall and shading control of a building, which can have a function as a banner or a signboard capable of performing card section by providing specific pictures or letters at the outer surface of the decorative timber blade unit.

Technical Solution

In order to accomplish the above object, the present invention provides a variably operable timber screen for three-dimensional decoration of a building exterior wall and shading control of a building. The timber screen includes: a pair of rails installed in parallel with each other in horizontal directions at a part of the building exterior wall and having a predetermined distance in upward and downward; a motor provided on an upper surface of a first end portion of an upper one of the pair of rails and rotating repeatedly in forward and reverse directions in response to output signals of a control unit, thereby generating rotational force required to drive the timber screen; a timing belt rotatably installed between a drive gear mounted to a shaft of the motor and an idle gear rotatably shafted at a lower portion of a second end portion of the upper rail to be positioned at a lower portion of the first end portion of the upper one of the pair of rails, so when the motor is driven in the forward and reverse directions, the timing belt rotates to allow all columns between a sliding column provided at a position close to the idle gear and a non-sliding column provided at a position close to the motor to be moved repeatedly in leftward and rightward directions along the rails; a plurality of pairs of rollers installed at position inside the pair of rails to be slidably movable responding to a rotational direction of the motor, and each of rollers has four wheels shafted at both sides of front and rear surfaces of a square body and a shaft provided at a center of the square body, in which some rollers installed inside the rails at positions close to the drive gear of the motor are maintained at fixed states; a plurality of columns installed in vertical directions between shafts of the pairs of rollers placed at vertically facing upper and lower positions to be rotatable by means of bearings, and configured such that when the power of the motor is transmitted thereto through the timing belt, the columns are moved in the leftward and rightward directions along the rails with the rollers and rotate repeatedly in the forward and reverse directions within a predetermined angle range together with an inner races of the bearing in response to an angular variation of blades of which angles vary according to an operation of a plurality of decorative timber blade units folded and unfolded, repeatedly; a plurality of bearings provided respectively on upper and lower connecting portion where the shafts of the roller and the columns are connected to each other, when the timing belt rotates in the forward and reverse directions in response to the forward and reverse directional rotations of the motor, each of bearings allows the columns to rotate on shafts of the rollers within the predetermined angle range in the forward and reverse directions; a rotational force transmitter bar provided such that a first end portion of the rotational force transmitter bar is fixed in a horizontal direction to an outer surface of an outer race of an associated bearing and a second end portion thereof is fixed to the timing belt by a belt fixture, and configured such that when the timing belt rotates in the forward and reverse directions according to the forward and reverse directional rotations of the motor, the rotational force transmitter bar allows to the columns installed adjacent to the idle gear to be moved in the leftward and rightward directions whereby the sliding columns except the non-sliding column are repeatedly moved to the leftward and rightward directions between the rails and rotate repeatedly in the forward and reverse directions within the predetermined angle range; the plurality of decorative timber blade units fixed to the front of adjacent columns in multiple-stage and arranged along vertical directions of the columns, the decorative timber blade units being inclined to each other in opposite directions to form wave shapes in horizontal directions, with coil springs being provided at lower surfaces of contact portions where the decorative timber blade units are in contact with each other, whereby when the columns connected through the rotational force transmitter bar and the bearings are moved along the rails in the leftward and rightward directions by the timing belt rotating according to the forward and reverse directional rotations of the motor, the sliding columns except the non-sliding column are repeatedly moved to the leftward and rightward directions to allow spaces between the columns repeatedly become narrow and wider and each of columns is repeatedly rotated around the inner races of associated bearings in the forward and reverse directions, and the decorative timber blade units are repeatedly folded and unfolded in the leftward and rightward directions on the coil springs as an axis to form a three-dimensional shape; and the control unit controlling the rotation of the motor in response to an input signal of a manipulation unit.

Hereinabove, the pair of rails may be molded such that the rails have cross-sections of a hollow rectangular shape partially open downward and a hollow rectangular shape partially open upward to form "⊔" and "⊓" shapes, respectively.

Furthermore, the shafts of the rollers may be fixed to the outer races of the bearings, and upper and lower end portions of the columns may be fixed to the inner races of the bearings, respectively.

Each of the plurality of decorative timber blade units may include: a blade that is molded to have a predetermined thickness using timber, formed such that front and rear surfaces of the blade are in parallel, and an exposed inclined surface for being exposed outward and a contact inclined surface for being in contact with an adjacent decorative timber blade unit are continuously formed on both sides of the blade in opposite directions; a blade fixture molded such that the blade fixture has a C-shaped cross-section, and is fixed to cover a part of the upper and lower surfaces including the rear surface of the blade, whereby the blade is fixed to the front of an associated column while being inclined at a predetermined angle; and a pair of spring fixtures fixed to opposite end portions of a lower surface of the blade, respectively, and allowing each of end portions of associated coil spring to be detachably coupled thereto.

Here, the blade may be molded in a separated structure with upper and lower blade parts having a same thickness, and the upper and lower blade parts may be integrated into a single body by using adhesive or fixing means, in which the lower blade part is formed with a half surface area of the upper blade part so as to reduce weight of the whole blade and is integrally fixed to a front portion of a lower surface of the upper blade part, and the blade fixture and the spring fixtures are fixed to a rear surface of the upper blade part and a lower surface of the rear thereof, respectively, for being invisible from front of the blade.

Specific pictures or letters may be provided at an outer surface of each of the decorative timber blade units, so the timber screen may have a function as a banner or a signboard.

Meanwhile, the variably operable timber screens for three-dimensional decoration of the building exterior wall and shading control of the building is characterized in that a plurality of the timber screens is repeatedly installed in succession at the building exterior wall.

Advantageous Effects

As described above, according to the variably operable timber screen for three-dimensional decoration of a building exterior wall and shading control of a building of the present invention, the timber screen can create a more attractive appearance of the building exterior wall by installing the timber screen formed by decorative timber blade units with a simple structure in variable operating type at the building exterior wall, and adjust the amount of sunlight incident through the window.

Furthermore, specific pictures or letters may be provided at the outer surface of the decorative timber blade unit, so that the timber screen may be used as a banner and a signboard capable of performing card section.

(Description of Reference Numerals)

| | |
|---|---|
| 10a, 10b: Rails | |
| 20: Motor | |
| 21: Drive gear | 22: Idle gear |
| 30: Timing belt | |
| 31: Thread | 32: Groove |
| 40: Roller | 41: Wheel |
| 42: Body | 43: Shaft |
| 50: Column | |
| 60: Bearing | |
| 61: Outer race | 62: Inner race |
| 70: Rotational force transmitter bar | |
| 71: Belt fixture | |
| 80: Decorative timber blade units | |
| 81: Blade | |
| 81a: Exposed inclined surface | |
| 81b: Contact inclined surface | |
| 811, 812: Upper and lower blades | |
| 813: Adhesive or fixing means | |
| 82: Blade fixture | 83: Spring fixture |
| 84: Coil spring | 841: Hook |
| 85: Pictures or letters | |
| 90: Manipulation unit | |
| 100: Control unit | |

MODE FOR INVENTION

Hereinafter, a preferred embodiment and operational state of the embodiment according to the present invention will be described in detail with reference to the accompanying drawings.

In describing the embodiment of the present invention, when the functions of conventional elements or the detailed description of elements related with the present invention may make the gist of the present invention unclear, a detailed description of those elements will be omitted.

Figure 1:
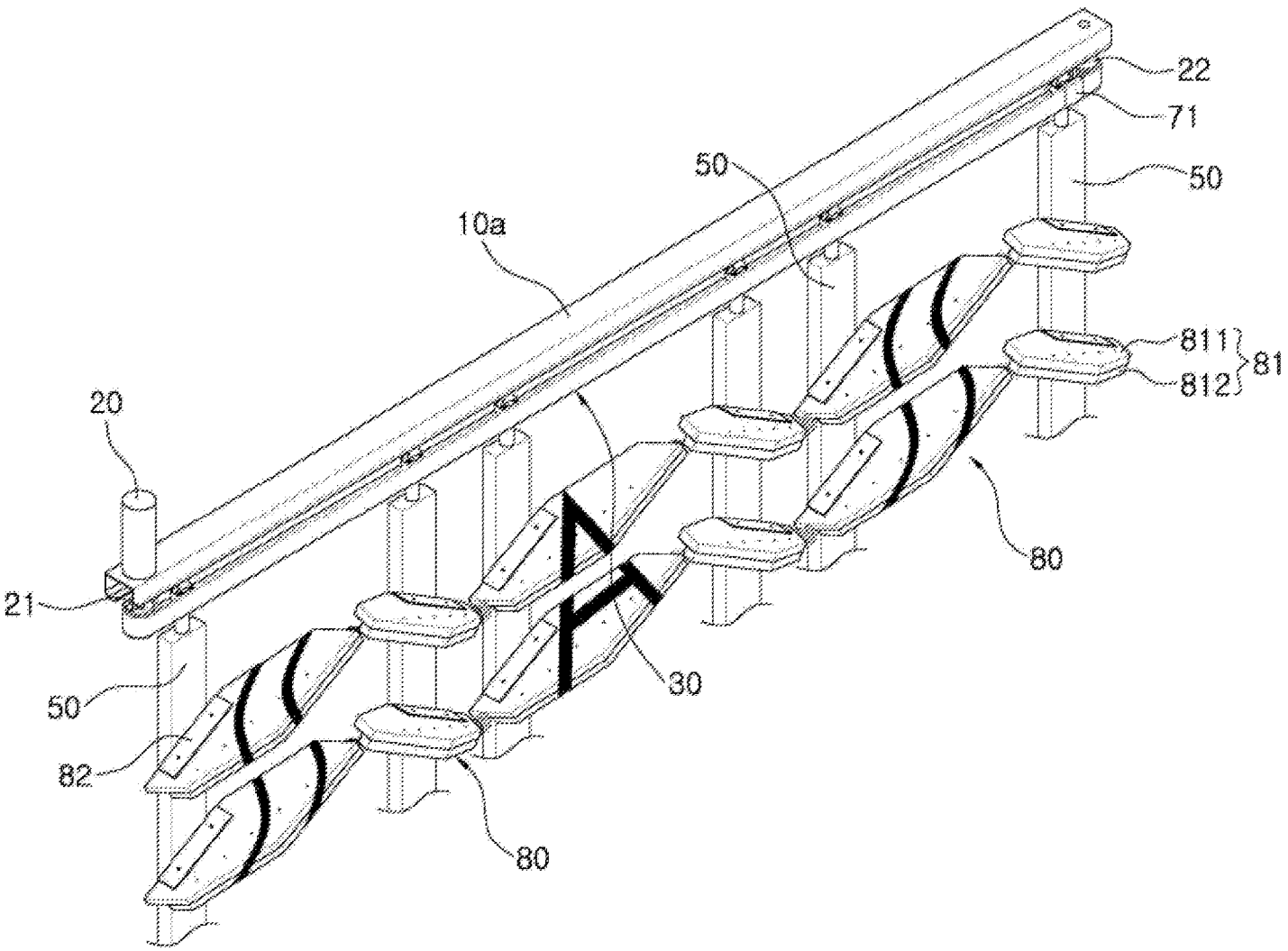
FIGS. 1 and 2 are partial perspective views showing variably operable timber screens according to the present invention in top and bottom angles.
Figure 2:
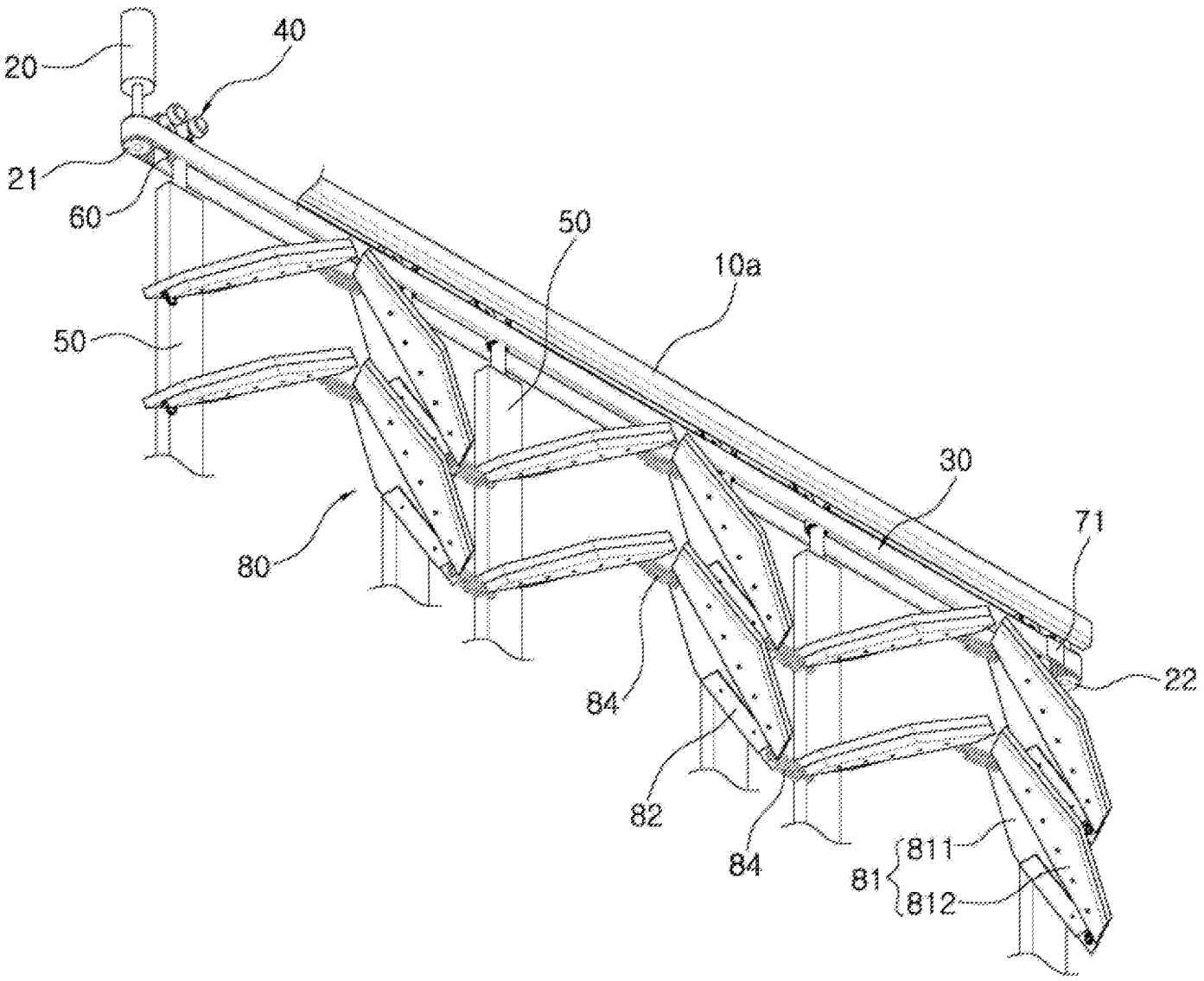
Figure 3:
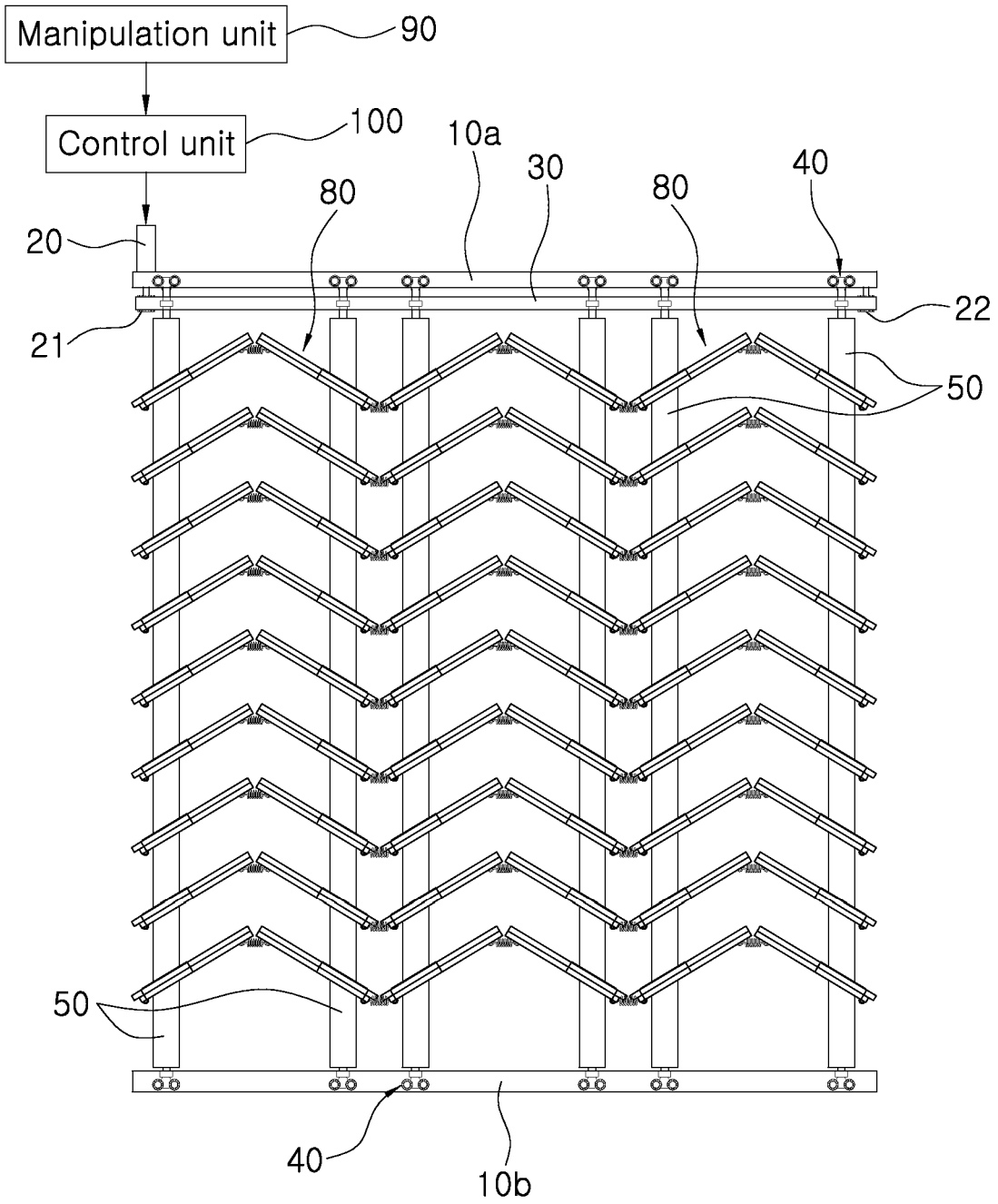
FIGS. 3 and 4 are elevation views showing the folding and unfolding variably operable timber screens according to the present invention.
Figure 4:
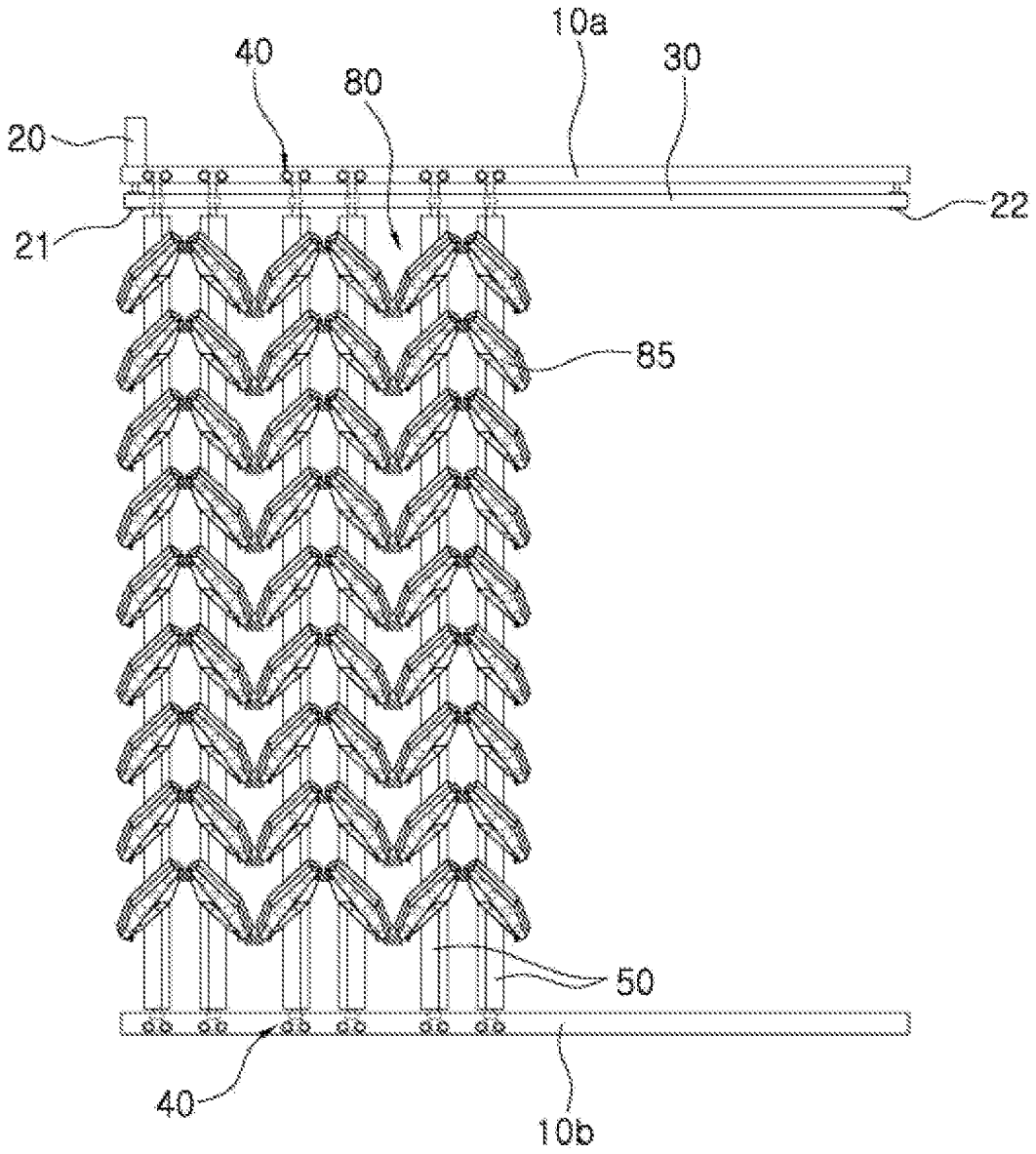
Figure 5:
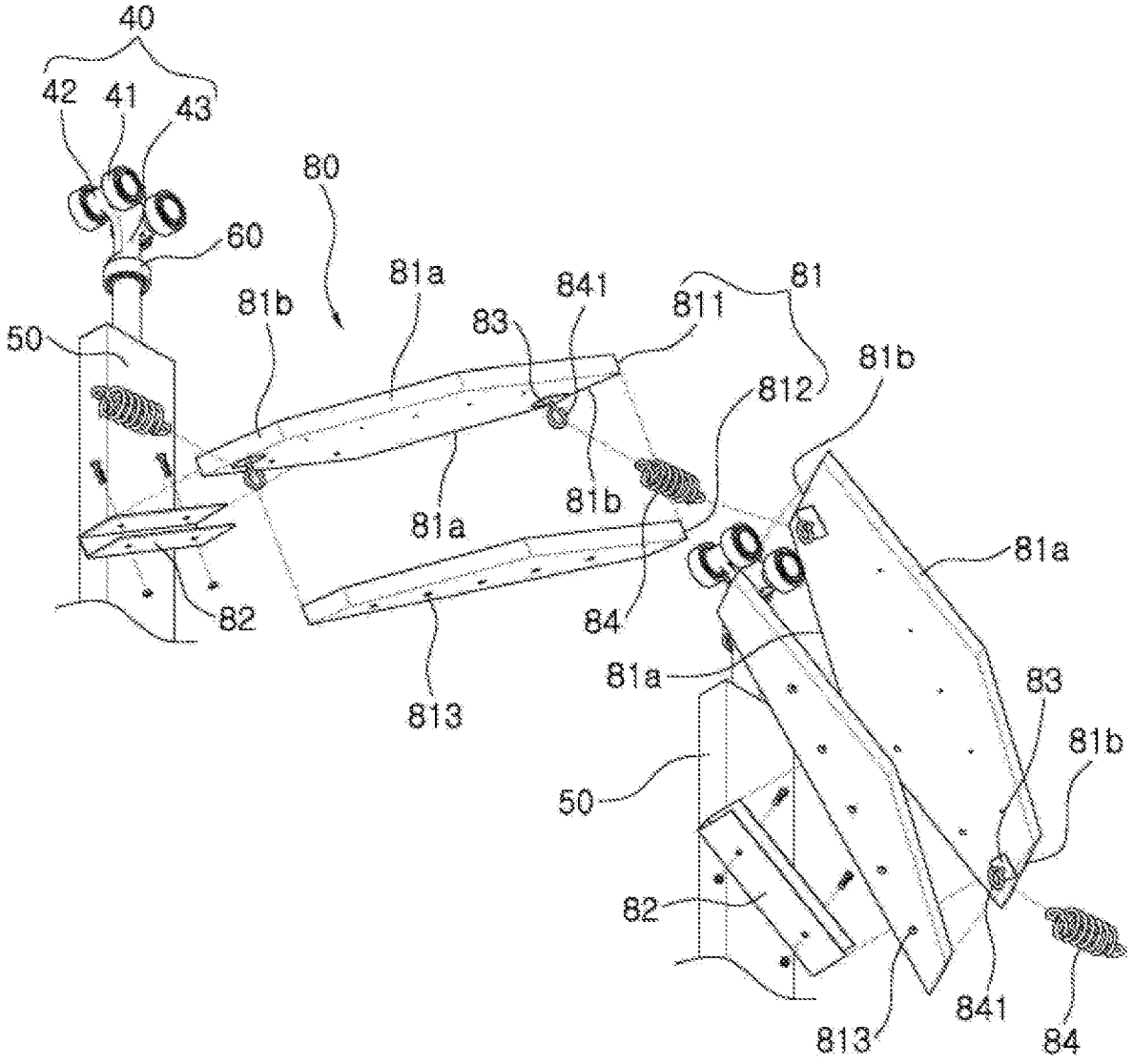
FIG. 5 is an exploded perspective view showing columns and decorative timber blade units of the variably operable timber screen according to the present invention.

FIGS. 1 and 2 are partial perspective views showing variably operable timber screens according to the present invention in top and bottom angles, FIGS. 3 and 4 are elevation views showing the variably operable timber screens folded and unfolded according to the present invention, and FIG. 5 is an exploded perspective view showing columns and decorative timber blade units of the variably operable timber screen according to the present invention.

Figure 6:
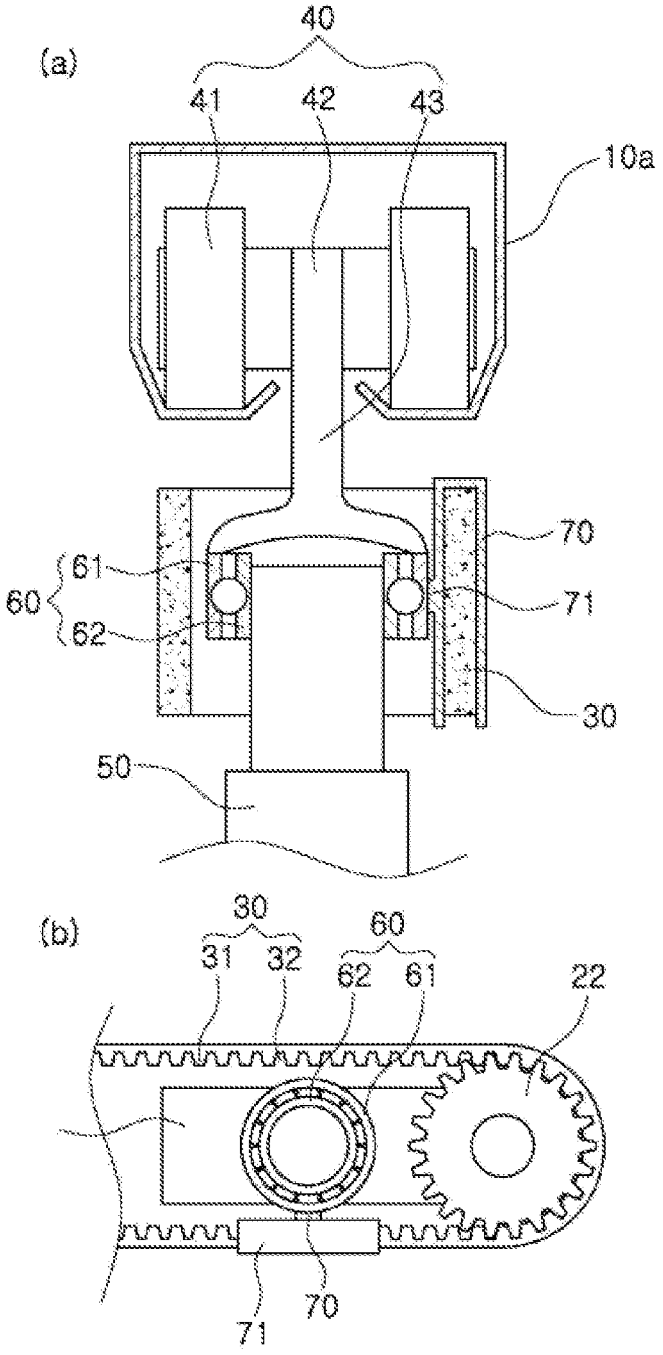
FIGS. 6*a* and 6*b* are partial cross-sectional views showing connecting states of a rail, a roller, a bearing, a timing belt, a rotational force transmitter bar and a column of the variably operable timber screen according to the present invention.
Figure 7:
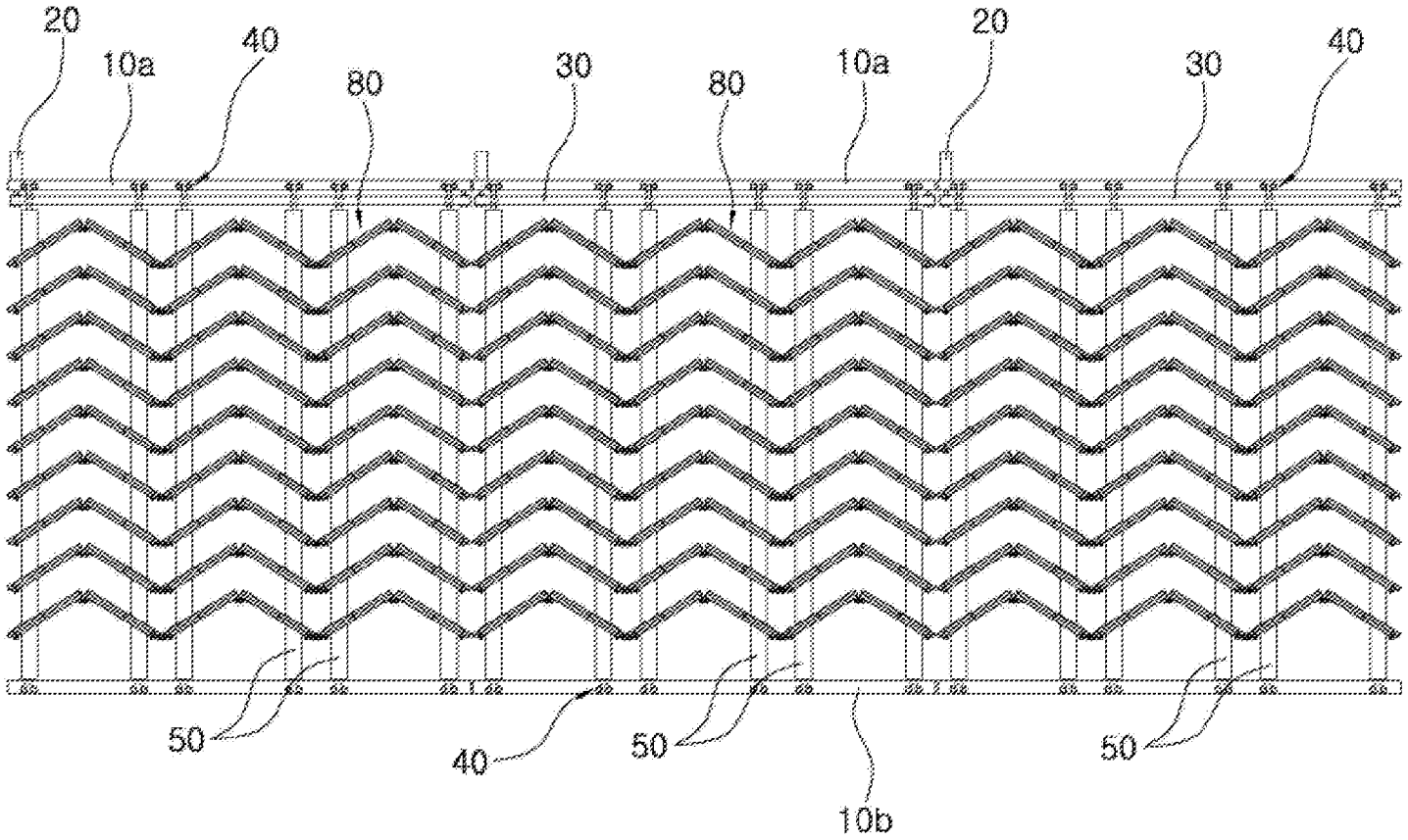
FIGS. 7 and 8 are elevation views showing that a plurality of variably operable timber screens according to the present invention installed in succession at an exterior wall are folded and unfolded.
Figure 8:
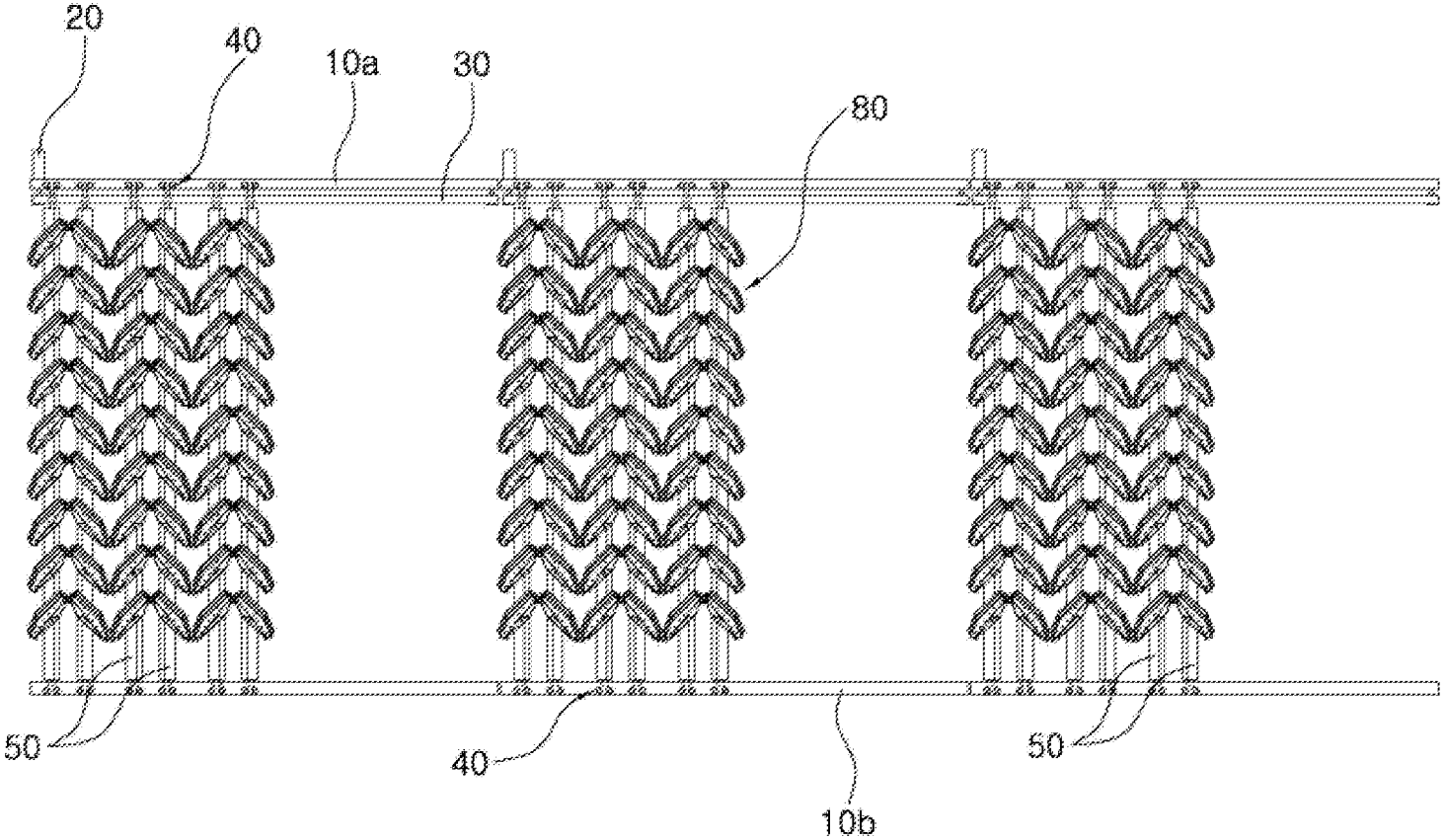

Moreover, FIGS. 6*a* and 6*b* are partial cross-sectional views showing connecting states of a rail, a roller, a bearing, a timing belt, a rotational force transmitter bar and a column of the variably operable timber screen according to the present invention, and FIGS. 7 and 8 are elevation views showing that a plurality of variably operable timber screens according to the present invention installed in succession at an exterior wall are folded and unfolded.

According to the present invention, the variably operable timber screen includes:

a pair of rails 10*a* and 10*b* installed in parallel with each other in horizontal directions at a part of the building exterior wall and having a predetermined distance in upward and downward;

a motor 20 provided on an upper surface of a first end portion of an upper rail 10*a* of the pair of rails 10*a* and 10*b* and rotating repeatedly in forward and reverse directions in response to an output signal of a control unit 100, thereby generating rotational force required to drive the timber screen;

the timing belt 30 rotatably installed between a drive gear 21 mounted to a shaft of the motor 20 and an idle gear 22 rotatably shafted at a lower portion of a second end portion of the upper rail 10*a* to be positioned at a lower portion of the first end portion of the upper rail 10*a* of the pair of rails 10*a* and 10*b*, so when the motor 20 is driven in the forward and reverse directions, the timing belt rotates to allow all columns between a sliding column provided at a position close to the idle gear 22 and a non-sliding column provided at a position close to the motor 20 to be moved repeatedly in leftward and rightward directions along the rails 10*a* and 10*b* and repeatedly transmitting power of the motor 20 to generate wider or narrow spaces between the columns;

a plurality of pairs of rollers 40 configured such that each of rollers has four wheels 41 shafted at both sides of front and rear surfaces of a square body 42 of a roller and a shaft 43 provided at a center of the square body 42 thereof, installed inside the pair of rails 10*a* and 10*b* to be slidably movable, and some rollers installed inside the rails 10*a* and 10*b* at positions close to the drive gear 21 of the motor 20 are maintained at fixed states;

a plurality of columns 50 installed in vertical directions between shafts 43 of the pairs of rollers 40 placed at vertically facing upper and lower positions to be rotatable by means of bearings 60, and configured such that when the power of the motor 20 is transmitted thereto through the timing belt 30, the columns are moved in the leftward and rightward directions along the rails 10*a* and 10*b* with the rollers 40 and rotate repeatedly in the forward and reverse directions within a predetermined angle range together with inner races 62 of the bearings 60 in response to an angular variation of blades 81 of which angles vary according to a folding and unfolding operation of a slat of a plurality of decorative timber blade units 80 repeatedly;

a plurality of bearings 60 provided respectively on upper and lower connecting portion where the shafts 43 of the roller 40 and the column 50 are connected to each other, and when the timing belt 30 rotates in the forward and reverse directions in response to forward and reverse directional rotation of the motor 20, the bearings allow the columns 50 to rotate on the shaft 43 of the roller 40 within the predetermined angle range in the forward and reverse directions;

a rotational force transmitter bar 70 is provided such that a first end portion of the rotational force transmitter bar is fixed in a horizontal direction to an outer surface of an outer race 61 of an associated the bearing 60 and a second end portion thereof is fixed to the timing belt 30 by a belt fixture 71, and when the timing belt 30 rotates in the forward and reverse directions in response to the forward and reverse directional rotation of the motor 20, the rotational force transmitter bar 70 enables the columns installed closed to the idle gear 22 to be moved in the leftward and rightward directions whereby the sliding columns except the non-sliding column installed close to the motor 20 are repeatedly removed to the leftward and rightward directions between the rails 10*a* and 10*b* and rotate repeatedly in the forward and reverse directions within the predetermined angle range;

the plurality of decorative timber blade units 80 fixed to fronts of adjacent columns 50 in multiple-stages and arranged along vertical directions of the columns, the decorative timber blade units being inclined to each other in opposite directions to form wave shapes in horizontal directions, with coil springs 84 being provided at lower surfaces of contact portions where the timber blade units are in contact with each other, whereby when the columns that is closed to the idle gear 22 and connected through the rotational force transmitter bar 71 and the bearing 60 are moved along the rails 10*a* and 10*b* in the leftward and rightward directions by the timing belt 30 rotating in response to the forward and reverse directional rotation of the motor 20, the sliding columns except the non-sliding column installed closed to the motor 20 are moved to the leftward and rightward directions to allow spaces between the columns repeatedly become narrow and wider and each of the columns is repeatedly rotated around the bearing 60 in the forward and reverse directions, and the decorative timber blade units are repeatedly folded and unfolded in the leftward and rightward directions on the coil springs 84 as an axis to form a three-dimensional shape; and the control unit 100 controlling the rotation of the motor 20 in the forward and reverse directions in response to an input signal of a manipulation unit 90.

The pair of rails 10*a* and 10*b* is molded such that the rails have cross-sections of a hollow rectangular shape partially open downward and a hollow rectangular shape partially open upward to form "⊏⊐" and "□" shapes.

Also, the shafts 43 of the roller 40 are fixed to the outer races 61 of the bearing 60, and upper and lower end portions of the columns 50 is fixed to inner races 62 of the bearings 60, respectively.

Each of decorative timber blade units 80 includes:

a blade 81 that is molded to have a predetermined thickness using timber, formed such that front and rear surfaces of the blade are in parallel, and an exposed inclined surface 81*a* and a contact inclined surface 81*b* for being in contact with a blade 81 of an adjacent decorative timber blade unit 80 are continuously formed on both sides of the blades in opposite directions;

a blade fixture 82 molded such that the blade fixture has a ⊂-shaped cross-section made of a metal plate, and is fixed to cover parts of upper and lower surfaces including the rear surface of the blade 81, and the blade 81 is fixed to the front of an associated column 50 while being inclined at a predetermined angle; and spring fixtures 83 fixed to opposite end portions of the lower surfaces of the blades 81 respectively, and each allowing an end portion of an associated coil spring 84 to be detachably coupled thereto.

Herein, the blade 81 is molded in a separated structure with upper and lower blade parts 811 and 812 having a same thickness, and the upper and lower blade parts are integrated into a single body by using adhesive or fixing means 813, in which the lower blade part 812 is formed with a half surface area of the upper blade part 811 so as to reduce weight of the whole blade and is integrally fixed to a front of a lower surface of the upper blade part 811, and the blade fixture 82 and the spring fixture 83 are fixed to a rear surface of the upper blade part 811 and a lower surface of the rear thereof, respectably, for being invisible from front of the blade.

Moreover, specific pictures or letters 85 are provided at an outer surface of each of decorative timber blade units 80, so the timber screen has a function as a banner or a signboard.

The variably operable timber screens for three-dimensional decoration of the building exterior wall and shading control of the building is characterized in that a plurality of the timber screens is repeatedly installed continuously at the building exterior wall.

Hereinafter, the operational effect of variably operable timber screens for three-dimensional decoration of the building exterior wall and shading control of the building of the present invention configured as above will be described.

Shown as FIGS. 1 to 8, the operational effect of variably operable timber screens for three-dimensional decoration of the building exterior wall and shading control of the building to which the present invention is applied has component elements of major technologies, such that the timber screen including the pair of rails 10*a* and 10*b*, the motor 20, the timing belt 30, the plurality of pairs of rollers 40, the plurality of columns 50, the plurality of bearing 60, the rotational force transmitter bar 70, the plurality of decorative timber blade units 80, the manipulation unit 90 and the control unit 100 is installed in the exterior wall of the building to create a more attractive appearance of the building and adjust the amount of sunlight incident through the window.

Shown as FIGS. 1 to 6*a*, the pair of rails 10*a* and 10*b* are molded respectively of the metal plate such that the rails have cross-sections of a hollow rectangular shape partially open downward and a hollow rectangular shape partially open upward to form "⊏⊐" and "□" shapes, and the rails is installed parallel with a predetermined vertically distance upper and lower at a part of the exterior wall of the building.

The motor 20 is mounted to the upper surface of the first end portion of the upper rail 10*a* of the pair of rails 10*a* and 10*b* in response to the output signal of the control unit 100 that generates an output signal set for an input signal of the manipulation unit 90 to which an user manipulates, and performs repeat rotation in the forward and reverse directions and generating the power for rotating the timber screen in the forward and reverse directions.

Herein, the motor 20 may be driven by the control unit 100 according to a motor operation signal input through the manipulation unit 90 that the user manipulates as needed. The motor may be automatically controlled by using a driving program previously input on the control unit 100, also using a wired or wireless communication device connected to the motor in the building or a remote place.

The timing belt 30 is rotatably installed between the drive gear 21 mounted to the shaft of the motor 20 and the idle gear 22 rotatably shafted at the lower portion of the second end portion of the upper rail 10*a*, so that the timing belt 30 is placed at the lower portion of the first end portion of the upper rail 10*a* of the pair of rails 10*a* and 10*b*, when the motor 20 is repeatedly driven in the forward and reverse directions, the timing belt transmits repeatedly the power of the motor 20 through the belt fixture 71, the rotational force transmitter bar 70 and the bearing 60, so that all columns between the sliding column 50 provided at a position closed to the idle gear 22 and the non-sliding column provided at a position close to the motor 20 are repeatedly moved along the rails 10*a* and 10*b* in the leftward and rightward directions, and the spaces of the columns become narrow or wider.

Moreover, each of rollers 40 has four wheels 41 that are shafted at the both sides of the front and rear surfaces of the square body 42, and the shaft 43 installed center of the square body 42, and the rollers are installed in inside the pair of rails 10*a* and 10*b* to be slidably moveable, so that the roller allows the associated column 50 described below to be moved in the leftward and rightward directions.

However, some rollers installed inside the rail 10*a* and 10*b* close to the drive gear 21 of the motor 20 are maintained at fixed states unlike the other rollers.

The plurality of columns 50 has square rod shapes, installed respectively in the vertical directions between the shafts 43 of the pairs of rollers placed at vertically facing upper and lower positions of the plurality of pairs of rollers 40 being inside the pair of rails 10*a* and 10*b* to be rotatable by the inner races 62 of the bearings 60 within the predetermined angular range.

In the plurality of columns 50, when the rotational force of the motor 20 in the forward and reverse directions is transmitted through the timing belt 30, the belt fixture 71, the rotational force transmitter bar 70 and the outer race 61 of the bearing 60, all sliding columns except the non-sliding column close to the drive gear 21 of the motor 20 are moved along the rails 10*a* and 10*b* in the leftward and rightward directions with the rollers 40, and the sliding and non-sliding columns 50 repeatedly rotated in the forward and reverse directions within the predetermined angle range together with the inner races 62 of the bearings 60 in response to an angular variation of which angles vary according to the operation of the blades 81 of the plurality of decorative timber blade units 80 folded and unfolded, and allow the plurality of decorative timber blade units to be repeatedly folded and unfolded, shown as FIGS. 4 and 3.

The plurality of bearings 60 are provided respectively on upper and lower connecting portions where the shafts 43 of the rollers 40 and the column 50 are connected, and when the timing belt 30 is rotated in the forward and reverse directions in response to the forward and reverse directional operation of the motor 20, the bearings allow the sliding and non-sliding columns 50 to be rotated on the shafts 43 of the rollers 40 within the predetermined angle range in the forward and reverse directions.

Shown as FIGS. 6*a* and 6*b*, the shafts 43 of the rollers 40 are fixed respectively to the outer races 61 of the bearings 60, the upper and lower end portions of the columns 50 are fixed respectively to the inner races 62 of the bearing 60, and the rotational force transmitter bar 70 is integrally provided between the outer surface of the outer race 61 and the belt fixture 71.

When the timing belt 30 is rotated in the forward and reverse directions in response to the rotational force of the motor 20, the rollers 40 are received the rotational force of the motor transmitted to the roller close to the idle gear 22 through the belt fixture 71 and the rotational force transmitter bar 70, and the rollers slide along the upper and lower pair of rails 10*a* and 10*b*, and allow the sliding and non-sliding columns 50 installed respectively between the upper and lower pair of rollers 40 to be rotated within the predetermined angle range together with the inner races 62 of the bearings 60 in response to the angular variation of the blades 81 and moved along the upper and lower pair of rails 10*a* and 10*b* in the leftward and rightward directions.

Shown as FIGS. 6*a* and 6*b*, the rotational force transmitter bar 70 is fixed such that the first end portion of the rotational force transmitter bar is integrally fixed in the horizontal direction to the outer surface of the outer race 61 of the associated bearing 60 that is provided between the column and the shaft of the roller close to the idle gear 22 in a first side inside the rails 10*a* and 10*b* of the plurality of columns 50 by welding, and the second end portion thereof to the inside of the timing belt 30 through the belt fixture 71 by welding.

The rotational force transmitter bar 70, when the timing belt 30 is rotated in the forward and reverse directions in response to the forward and reverse directional operation of the motor 20, transmits the rotational force transmitted through the belt fixture 71 to the roller and the column close to the idle gear 22 in a state of being converted into leftward and rightward directional moving force, and allows other columns except the non-sliding column installed at the position closed to the motor 20 to be repeatedly moved in the leftward and rightward directions between the upper and lower rails 10*a* and 10*b*, and rotated repeatedly in the forward and reverse directions within the predetermined angle range in response to an angular variation of the blades 81 of the plurality of decorative timber blade units 80.

Meanwhile, shown as FIG. 5, each of the plurality of decorative timber blade units 80 is configured with the blade 81, the blade fixture 82, the spring fixture 83, and the coil spring 84, integrally fixed to the front of the adjacent columns 50 in rows along the vertical directions of the columns by welding and arranged in state of being inclined to each other in opposite directions to form the wave shapes in the horizontal directions, and the lower surfaces of the contact portions where the timber blade units are in contact with each other have self-elasticity and the coil springs 84 performing a function as a hinge.

Since the plurality of decorative timber blade units 80 maintain an integrally connected form together by the coil springs 84, the timing belt 30 is rotated in the forward and reverse directions in response to the forward and reverse directional operation of the motor 20, thereby when the roller installed close to the idle gear 22 of associated the timing belt 30 and the column connected to the roller are moved along the rails 10*a* and 10*b* in the leftward and rightward directions by the belt fixture 71, the rotational force transmitter bar 70 and the bearing 60, and the other columns except the non-sliding column close to the motor 20 are moved in the leftward and rightward directions so that the spaces between the columns repeatedly become narrow or wider.

When the columns 50 are moved along the rail 10*a* and 10*b* in the leftward and rightward directions, since the columns 50 rotate repeatedly in the forward and reverse directions with the inner races 62 of the bearings 60 in response to the angular variation of the blades 81 of the plurality of decorative timber blade units 80, the plurality of decorative timber blade units 80 fixed in inclined to the fronts of the columns 50 respectively are repeatedly folded and unfolded in the leftward and rightward directions on the coil springs 84 as the axis, as shown FIGS. 3 and 4, so an overall shape of the plurality of decorative timber blade units is automatically changed.

Therefore, the plurality of decorative timber blade units creates a more attractive appearance of the building and adjusts the amount of sunlight incident through the window.

Herein, in composition elements of the plurality of decorative timber blade units 80, the blade 81 is molded to have the predetermined thickness using timber basically, formed such that the front and rear surfaces of the blade are in parallel, and an exposed inclined surface 81*a* for being exposed outward and a contact inclined surface 81*b* for being in contact with an adjacent decorative timber blade unit 80 are continuously formed on both sides of the blade in opposite directions.

The blade fixture 82 is bending-molded to have the ⊂-shaped cross-section made of the metal plate, and fixed to cover the part of the upper and lower surfaces including the rear surface of the blade 81.

Also, the blade fixture 82 allows the blade 81 of each of the plurality of decorative timber blade units 80 to be fixed to the front of the associated column 50 in inclined within the predetermined angle by welding, and when the columns 50 are moved in the leftward and rightward directions along the rails 10*a* and 10*b* in response to the rotational direction of the motor 20, the blade 81 varies in angle, and the columns 50 repeatedly rotate in the forward and reverse directions with the inner races of the bearings 60.

The pair of spring fixtures 83 are fixed to the opposite end portions of the lower surfaces of the blade 81 and each allowing a hook 841 provided on both end portions of the coil spring 84 to be detachably coupled thereto, when a column 50 connected to the rotational force transmitter bar 70 repeatedly rotates in the forward and reverse directions with the inner race 62 of the bearing 60 in response to the angular variation of the blade 81 of the plurality of decorative timber blade units 80 by rotating the timing belt 30 in the forward and reverse directions in response to the rotational direction of the motor 20, the spring fixtures enable the coil spring 84 to provide the function as the hinge and the elasticity between the plurality of decorative timber blade units 80 adjacent to each other, and the plurality of decorative timber blade units 80 to be folded and unfolded repeatedly in the leftward and rightward directions, so an overall three-dimensional shape of the plurality of decorative timber blade units is changed into various shapes.

Meanwhile, in the present invention, when the blades 81 of the plurality of decorative timber blade units 80 are molded using timber, each of the blades 81 is not molded into a single body in consideration of the weight and cost, as shown as FIG. 5, but the blade 81 is molded in a separated structure with the upper and lower blade parts 811 and 812 having the same thickness, and the upper and lower blade parts are integrated into a single body by using adhesive or fixing means 813.

Moreover, the lower blade part 812 is formed with the half surface area of the upper blade part 811 and integrally fixed to the front portion of the lower surface of the upper blade part 811 so as to reduce weight of the whole blade, and since the blade fixture 82 and the spring fixture 83 are fixed to the rear surface of the upper blade part 811 and the lower surface of the rear thereof, respectively, the blade fixture 82 and the spring fixture 83 may be invisible when viewed from the front of the blade 81 so that the appearance of the timber screen may be kept attractive.

Furthermore, according to the present invention, the specific pictures or letters 85 are provided at the outer surfaces of the plurality of decorative timber blade units 80, as shown as FIGS. 1 and 4, thereby the timber screen has the function as the banner or a signboard capable of performing card section through three-dimensional movement of the plurality of decorative timber blade units 80.

In the composition elements of the present invention, the numbers of the plurality of pairs of rollers 40, the plurality of columns 50, the plurality of bearings 60, and the plurality of decorative timber blade units 80 are determined in consideration of the capacity of the motor 20, the total height of the column 50, and the weight of the decorative timber blade units 80. In the accompanying drawings, six or six pairs of the timber screens are provided on the motor, but the number of the timber screens may not be limited.

As described above, the variably operable timber screen for three-dimensional decoration of a building exterior wall and shading control of a building includes the pair of rails 10*a* and 10*b*, the motor 20, the timing belt 30, the plurality of pairs of rollers 40, the plurality of columns 50, the plurality of bearings 60, the rotational force transmitter bar 70, the plurality of decorative timber blade units 80, the manipulation unit 90, and the control unit 100. Here, the plurality of timber screens may be continuously provided at the exterior wall of the building according to needs of a building owner, as shown in FIGS. 7 and 8, and may be operated respectively or together to create a more attractive appearance of the building exterior wall, and adjust the amount of sunlight incident through the window.

The present invention is described in detail with reference to preferred embodiment. However, it is not limited to only the example embodiments set forth herein and disclosed in the claims, and those skilled in the art will appreciate that the present invention can transform or modify without departing from the technical scope of the present invention.

What is claimed is:

1. A variably operable timber screen for three-dimensional decoration of a building exterior wall and shading control of a building, the timber screen comprising:

a pair of rails arranged in parallel with each other in horizontal directions at a part of the building exterior wall such that the pair of rails are vertically spaced apart from each other to include an upper rail and a lower rail;

a motor provided on an upper surface of a first end portion of the upper rail of the pair of rails and configured to rotate repeatedly in forward and reverse directions in response to output signals of a control unit, so the motor generates rotational force and operates the timber screen by rotating a timing belt of the timber screen;

the timing belt rotatably installed between a drive gear mounted to a shaft of the motor and an idle gear rotatably shafted at a lower portion of a second end portion of the upper rail, so when the motor is driven in the forward and reverse directions, the timing belt rotates to allow a plurality of sliding columns including a sliding column provided at a position close to the idle gear, except a non-sliding column provided at a position close to the drive gear of the motor, to be moved repeatedly in leftward and rightward directions along the pair of rails;

a plurality of pairs of movable rollers installed at positions inside the pair of rails to be slidably movable responding to a rotational direction of the motor, and a pair of fixed rollers installed inside the pair of rails at positions close to the drive gear of the motor such that the fixed rollers are maintained at fixed states;

the plurality of sliding columns and the non-sliding column installed in vertical directions between shafts of the pairs of movable rollers and the pair of fixed rollers placed at vertically facing upper and lower positions and supported by bearings, and configured such that when the rotational force of the motor is transmitted thereto through the timing belt, the sliding columns are moved in the leftward and rightward directions along the rails with the movable rollers and rotate repeatedly in the forward and reverse directions within a predetermined angle range together with inner races of the bearings in response to an angular variation of blades of which angles vary according to an operation of a plurality of decorative timber blade units folded and unfolded repeatedly;

the bearings provided respectively on upper and lower connecting portions where the shafts of the fixed and movable rollers and the non-sliding and sliding columns are connected to each other to allow the non-sliding and sliding columns to rotate on the shafts of the fixed and movable rollers within the predetermined angle range in the forward and reverse directions;

rotational force transmitter bars provided such that first end portions of the rotational force transmitter bars are fixed in a horizontal direction to outer surfaces of outer races of the bearings and second end portions thereof are fixed to the timing belt by belt fixtures, and configured such that when the timing belt rotates in the forward and reverse directions, the rotational force transmitter bars transmit the rotational force of the motor to the non-sliding and sliding columns to move the sliding columns, except the non-sliding column close to the drive gear of the motor, repeatedly in the leftward and rightward directions between the pair of rails and rotate the non-sliding and sliding columns repeatedly in the forward and reverse directions within the predetermined angle range;

the plurality of decorative timber blade units fixed to fronts of the non-sliding and sliding columns in rows and arranged along vertical directions of the non-sliding and sliding columns, the decorative timber blade units being inclined to each other in opposite directions to form wave shapes in horizontal directions, with coil springs being provided at lower surfaces of contact portions where the timber blade units are in contact with each other, whereby the sliding columns are moved along the pair of rails in the leftward and rightward directions according to forward and reverse directional rotations of the motor such that spaces between the non-sliding and sliding columns repeatedly become narrow and wider, and when the non-sliding and sliding columns are rotated repeatedly around the inner races of the bearings in the forward and reverse directions, the timber blade units are repeatedly folded and unfolded in the leftward and rightward directions on the coil springs as an axis to form a three-dimensional shape; and the control unit controlling the rotation of the motor in response to an input signal of a manipulation unit.

2. The timber screen of claim 1, wherein the pair of rails is molded such that the rails have cross-sections of a first hollow rectangular shape partially open downward and a second hollow rectangular shape partially open upward.

3. The timber screen of claim 1, wherein the shafts of the fixed and movable rollers are fixed to the outer races of the bearings and upper and lower end portions of the non-sliding and sliding columns are fixed to the inner races of the bearings, respectively.

4. The timber screen of claim 1, wherein specific pictures or letters are provided at an outer surface of each of the decorative timber blade units, so the timber screen has a function as a banner or a signboard.

5. The timber screen of claim 1, wherein each of the decorative timber blade units includes:

blade that are molded to have a predetermined thickness using timber, formed such that front and rear surfaces of each of the blades are in parallel, and an exposed inclined surface for being exposed outward and a contact inclined surface for being in contact with an adjacent decorative timber blade unit are continuously formed on both sides of each of the blades in opposite directions;

a blade fixture molded such that the blade fixture has a c-shaped cross-section, and is fixed to cover a part of the upper and lower surfaces including the rear surface of each of the blades, whereby each of the blades is fixed to the front of an associated column of the non-sliding and sliding columns while being inclined at a predetermined angle; and a pair of spring fixtures fixed to opposite end portions of a lower surface of each of the blades, respectively, and each allowing an end portion of an associated coil spring of the coil springs to be detachably coupled thereto.

6. The timber screen of claim 5, wherein each of the blades is molded in a separated structure with upper and lower blade parts having a same thickness, and the upper and lower blade parts are integrated into a single body by using adhesive or fixing means, wherein the lower blade part is formed with a half surface area of the upper blade part so as to reduce weight of the integrated single body of each of the blades and is integrally fixed to a front portion of a lower surface of the upper blade part, and the blade fixture and the pair of spring fixtures are fixed to a rear surface of the upper blade part and a lower surface of the rear thereof, respectably, for being invisible from front of each of the blades.

* * * * *